US006406015B1

(12) United States Patent
Lehmann et al.

(10) Patent No.: US 6,406,015 B1
(45) Date of Patent: Jun. 18, 2002

(54) DEVICE FOR SUPPLYING LABELS

(75) Inventors: Rainer Lehmann, Nottuln; Heinrich Eckholt, Munster, both of (DE)

(73) Assignee: Langguth GmbH & Co., Senden-Bosensell (DE)

( * ) Notice: Subject to any disclaimer, the term of this patent is extended or adjusted under 35 U.S.C. 154(b) by 0 days.

(21) Appl. No.: 09/743,119

(22) PCT Filed: May 3, 2000

(86) PCT No.: PCT/DE00/01441

§ 371 (c)(1),
(2), (4) Date: Jan. 5, 2001

(87) PCT Pub. No.: WO00/68090

PCT Pub. Date: Nov. 16, 2000

(30) Foreign Application Priority Data

May 8, 1999 (DE) ..... 199 21 432

(51) Int. Cl.[7] ..... B65H 5/08

(52) U.S. Cl. ..... 271/11; 271/10.01; 271/14; 271/107; 271/225; 271/269; 271/171

(58) Field of Search ..... 271/10.01, 11, 271/14, 107, 225, 171, 267, 269, 184

(56) References Cited

U.S. PATENT DOCUMENTS

| | | | | | |
|---|---|---|---|---|---|
| 1,517,255 | A | | 12/1924 | Scholin | |
| 4,002,332 | A | * | 1/1977 | Hoenigmann | 271/11 |
| 4,099,712 | A | | 7/1978 | Martin | |
| 4,397,458 | A | * | 8/1983 | Edstrom | 271/14 |
| 4,462,585 | A | * | 7/1984 | Gieson et al. | 271/11 |
| 4,479,644 | A | * | 10/1984 | Bartimes et al. | 271/107 |
| 4,639,207 | A | * | 1/1987 | Slat et al. | 271/14 |
| 4,840,366 | A | * | 6/1989 | Jonston et al. | 271/14 |
| 5,161,791 | A | * | 11/1992 | Akiyama et al. | 271/107 |
| 5,374,052 | A | | 12/1994 | Folsom | |
| 5,411,248 | A | * | 5/1995 | Yamaguchi | 271/171 |
| 5,816,156 | A | * | 10/1998 | Minkle | 271/107 |
| 5,988,624 | A | * | 11/1999 | Nakagawa | 271/11 |

FOREIGN PATENT DOCUMENTS

| | | | | |
|---|---|---|---|---|
| DE | 23 57 610 | | 3/1975 | |
| DE | 33 05 350 | | 1/1986 | |
| DE | 43 44 474 | | 1/1995 | |
| DE | 83 31 867 | | 6/1997 | |
| JP | 0093744 | * | 7/1980 | 271/11 |

OTHER PUBLICATIONS

*IBM Technical Disclosure Bulletin,* "Device For Separating And Carrying Off Sheets", J. Gutteling, XP–002149002, VI. 2., No. 5, Feb. 1960.

* cited by examiner

*Primary Examiner*—H. Grant Skaggs
(74) *Attorney, Agent, or Firm*—Merchant & Gould P.C.

(57) ABSTRACT

The invention relates to a labeling machine for wet adhesive labels comprising a gluing and application device which holds and guides the labels. A label magazine is connected upstream from the gluing and application device to which labels are fed from said label magazine. During the processing of multiple labels, the label magazine is configured as a support platform with a support wall that extends over the entire length of the platform, and transporting means for transporting the labels are provided above the support platform in the vicinity of the support wall. Said transporting means transfer the detached label to a label conveyor arranged above the support wall, and a conveyor platform is provided on the label conveyor. The label is conveyed, in a conveying direction of the label conveyor, on said conveyor platform up to a specified position, and is then conveyed, perpendicular to the conveying direction of the label conveyor, to the feed position of the gluing and application station or to the feed side of the label shaft.

9 Claims, 4 Drawing Sheets

DEVICE FOR SUPPLYING LABELS

Figure 1:
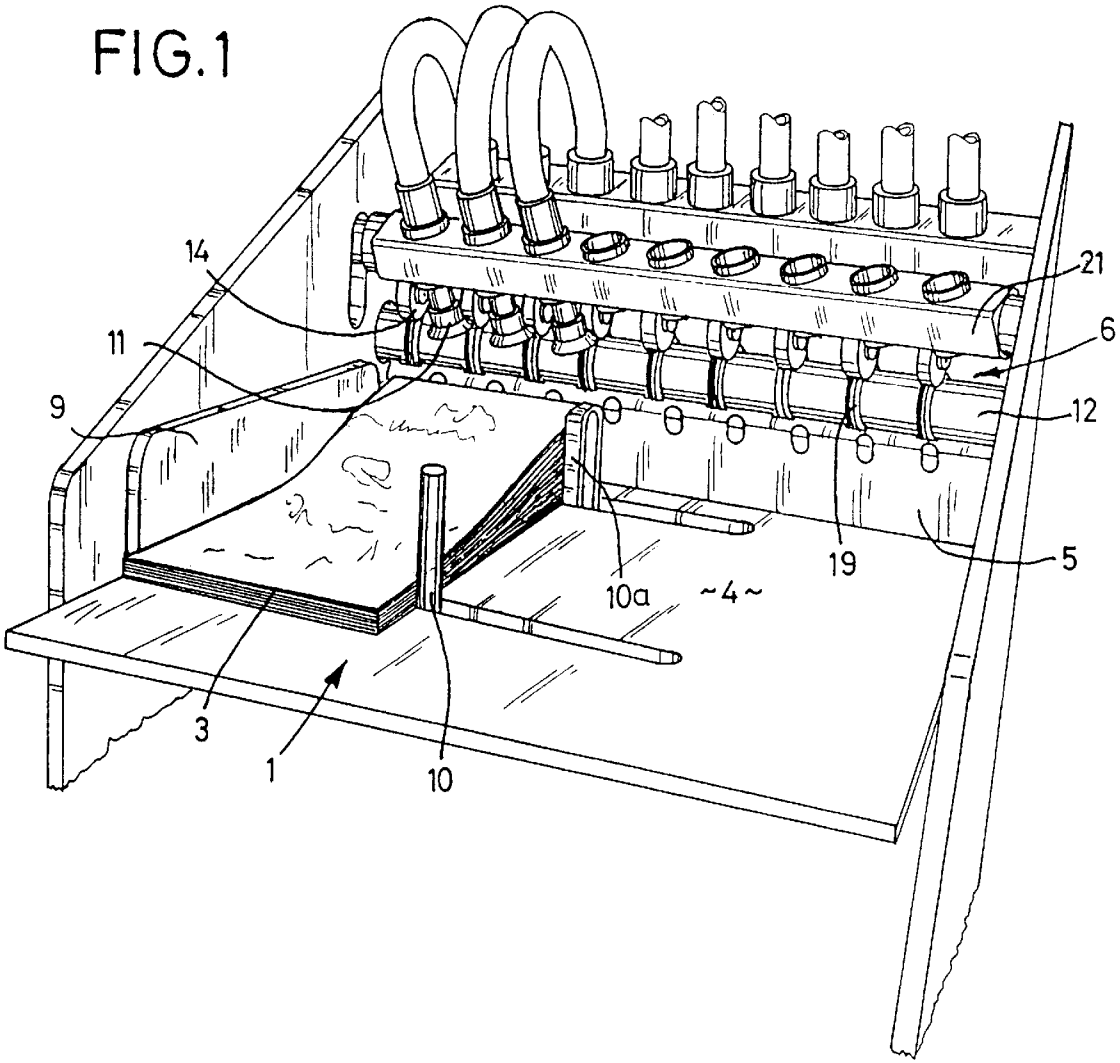

The invention relates to a labeling machine for wet adhesive labels according to the precharacterizing clause of the main claim.

Labeling machines representing the genre are known, for example, from DE 33 05 350 C2 or DE-PS 23 57 610 and are applied on a large scale in practice.

Recently, so-called "multiple labels" have been used as labels. In these multiple labels, underneath the main label are arranged sheets containing additional information. The main label has a closed design and, after it has been applied to the object to be labeled, can be opened via a perforated line, so that the additional printed information arranged underneath and carried by the main label can then be read.

These multiple labels are formed with completely different lengths, widths, and thicknesses, and the multiple-layer enclosure can be situated at completely different spots on the back side of the main label. The processing of these multiple labels in the present-day wet-adhesive labeling machines belonging to the prior art is virtually impossible, since an adjusting of the transport means for the labels to multiple labels of such various shapes implies an amount of effort that cannot in practice be realized.

Multiple labels, however, display an unmistakable, clear, and straight leading edge arranged on their left front side, which edge can be utilized as the lay-out edge.

The object of the invention is to create a labeling machine, specifically a wet adhesive labeling machine, in which machine provision is made for a label magazine into which labels of completely different shapes can be places, and in which machine an effortless isolation and conveying of the individual labels to the gluing and application device is possible in spite of the fact that the labels have such various shapes. In this, the machine should be adjustable, in a quick manner and without great effort by ordinary personnel, to the most various sizes, thicknesses, and lengths of the multiple labels, so that by means of a labeling machine the most various vessels can be provided with the most various multiple labels.

This object of the invention is achieved through the teaching of the main claim.

Advantageous configurations are explained in the dependent claims.

Expressed in other terms, it is proposed that one edge of the label be utilized as the lay-out edge and that the label magazine be formed as a support platform that is provided with a support wall extending over that entire length of the platform, against which wall the edge of the labels, preferably the front left edge, can now be placed.

In the region of this support wall, provision is then made above the support platform for transport means for the labels, which means transfer the isolated label to a label conveyor arranged, for example, above the support wall, the isolation of the label taking place through this transport means.

Subsequent to the label conveyor, provision is made for a conveyer platform to which the label transported by the label convey is transferred and on which the label is conveyed in the feed direction of the label conveyer up to a specified position, for example once again a support wall, and then conveyed perpendicular to this feed direction to the feed position of the gluing and application device. The isolated label can then be supplied to the vessel to be labeled in the conventional manner by the gluing and application device belonging to the prior art.

According to the invention, preferably arranged on the support platform perpendicular to the layout wall is an abutment wall, against which the label can be placed; in addition, provision is made, for example, for a counter-support on the support platform that can be set to the width of the label through a simple adjustment and thereby ensures a secure supporting of the stack of labels.

As the transport means for the isolated labels, which at the same time also isolates the labels, according to the invention vacuum suction apparatus are preferably used; however, instead of the vacuum suction apparatus, the labels can also be removed from above by frictional coupling or from below by frictional coupling. The crucial thing here is that the isolated label be delivered to the draw-in roller of the label conveyer, this label conveyer consisting of a draw-in roller and a counter roller and the draw-in roller preferably being provided with rubber rings. If vacuum suction apparatus are used, then these descend onto the topmost label in the region of the support wall, grip the label, lift it high, and in the process swing in such a manner that they are now able to deliver the front edge of the label to the draw-in roller.

On the conveyor platform, to which the label is delivered by the label conveyor, the label is once again conveyed conventionally to a specified position, for example once again to a set-up wall, and then, perpendicularly to this conveying direction, is pushed forward by means of driving elements and thus delivered to the gluing and application device. According to a preferred example of embodiment of the invention, the driving elements are arranged on a carriage that is movable back and forth by means of a pneumatic piston-cylinder arrangement. The piston-cylinder arrangement with the carriage is in turn arranged on a support that is adjustable by hand in the direction of the piston-cylinder arrangement, i.e. it can be adjusted to labels of different widths, so that the stroke of the piston-cylinder arrangement can always remain the same, independently of how wide the label is, so that complicated machine adjustments are not required here and a relatively cost-effective pneumatic piston-cylinder arrangement can be used.

Figure 2:
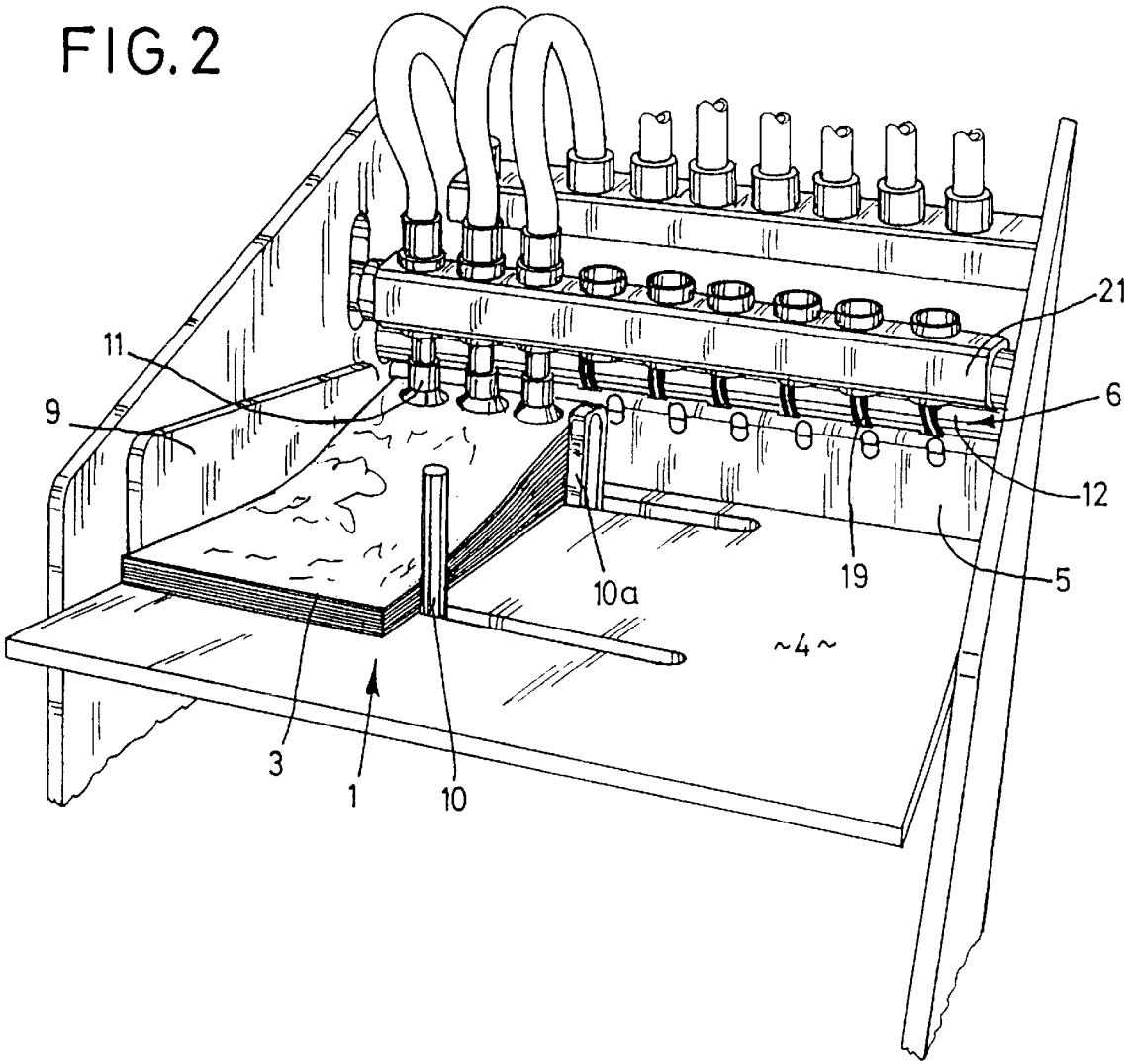
Figure 3:
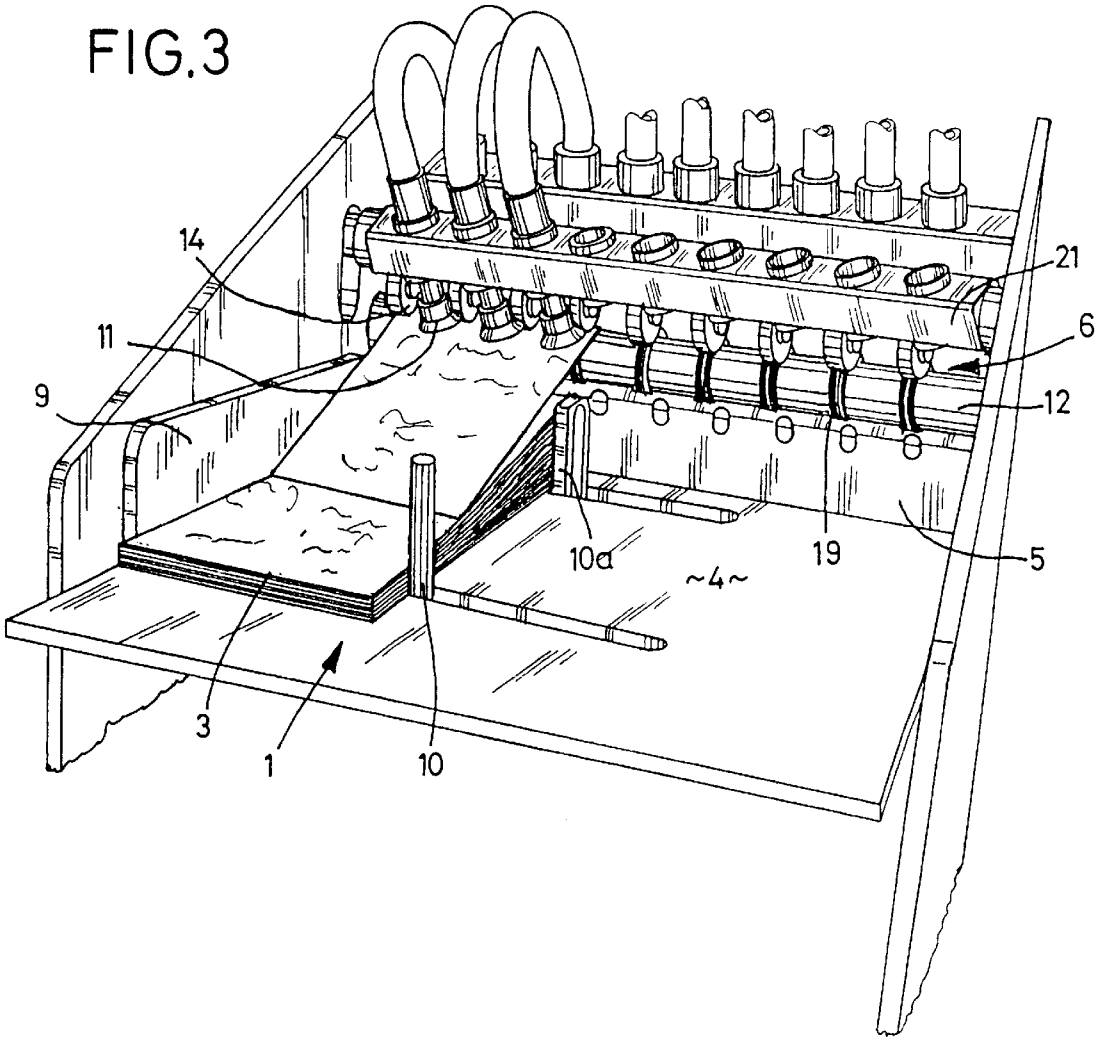
Figure 4:
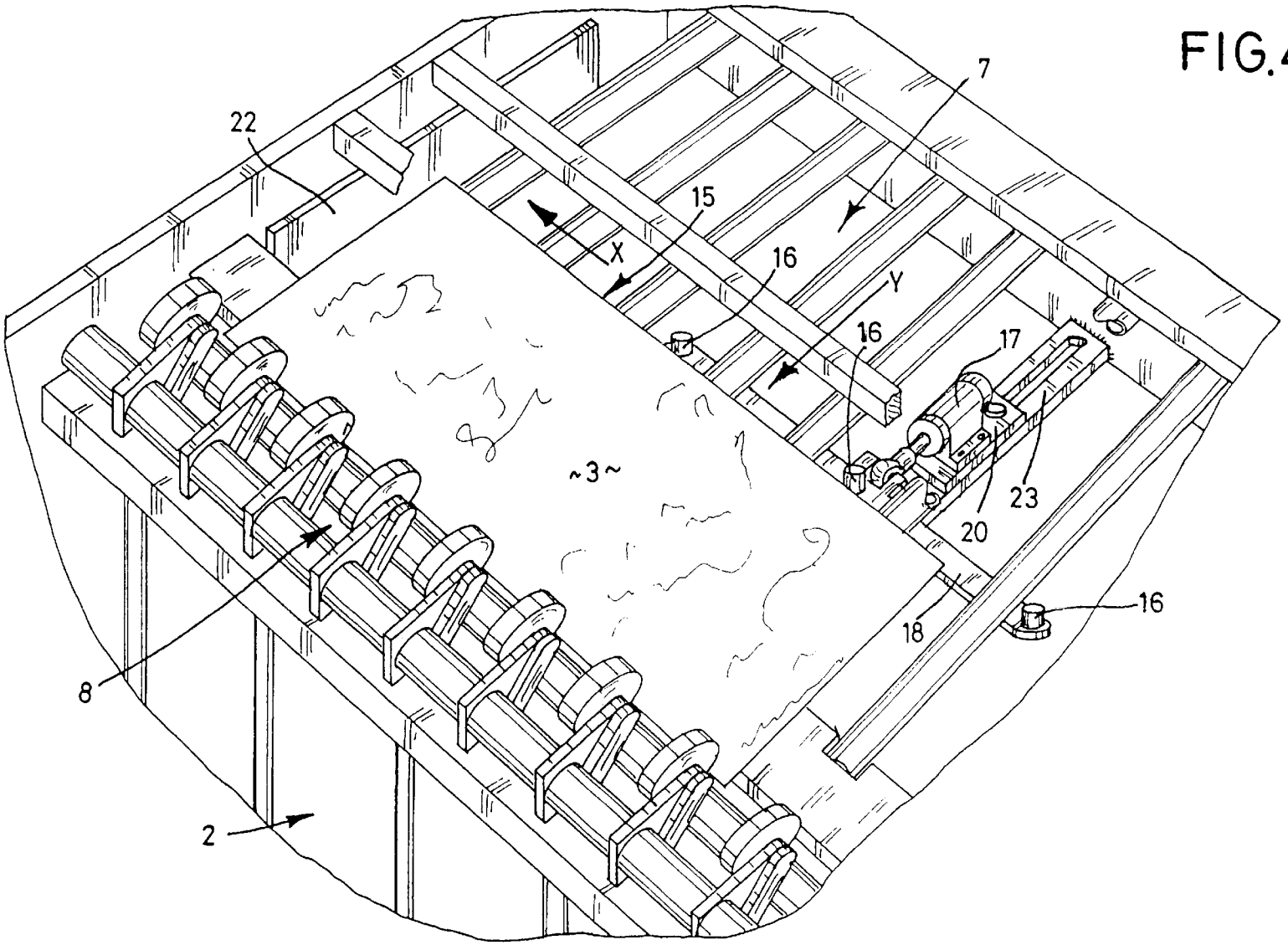

In the following, an example of embodiment of the invention is explained with the aid of the drawings. They show:

FIG. 1: a view of the labeling machine with support platform and transport means FIG. 2: a detail from FIG. 1, the vacuum suction apparatus having been lowered onto the front edge of the label FIG. 3: the raised-up and swung vacuum suction apparatus FIG. 4: a view of the conveyer platform with a label lying thereon, which label is conveyed to the gluing and application device Recognizable in FIG. 1 is a labeling magazine 1, which is formed as a support platform 4 and displays a set-up wall 5, against which is set the front edge of a stack of labels 3. The side edge of the label rests against an abutment wall 9 and the stack of labels is supported by counter supports 10 and 10*a,* which are easily adjustable by hand to the width of the label 3 or stack of labels, as the case may be. Recognizable above the set-up wall are vacuum suction apparatus 11, a number of which are arranged on a swinging carriage 21. Recognizable further in FIG. 1 is a label conveyer 6, displaying a draw-in roller 12 and a counter roller 14, the draw-in roller 12 being equipped with rubber rings 19. The vacuum suction apparatus 11 can be used in a number that is adaptable to the size of the label.

FIG. 2 shows that the vacuum suction apparatus 11 are swung forward through a swinging of the pivoting carriage 21 and are lowered onto the front edge of the label 3. At this point, the vacuum in the suction heads of the vacuum suction apparatus 12 [should be 11 ] becomes active and—as shown in FIG. 3—the suction devices lift the label up, and through a swinging of the pivoting carriage 21 the front edge of the label 3 is now fed to the label conveyer 6 in such a way that these front edges arrive between the draw-in roller 12 and the counter roller 14 and can be conveyed by this label conveyer 6.

FIG. 4 shows a view of a conveyer platform 7 loaded by the label conveyor 6, on which conveyer platform the label 3 is conveyed to a specified location, for example once again a support wall 22. Recognizable in FIG. 4 is a part of a gluing and application device 2, as well as a label well 8, into which the label 3 is to be transferred.

Underneath the top side of the conveyer platform 7 is arranged a carriage 18, which bears driving elements 16, which can be set against the rear lateral edge 15 of the label 3, the carriage 18 being joined to a support 20 that bears a pneumatic piston-cylinder arrangement 17. The support 20 is adjustable on a rail 23.

In FIG. 4, the conveying direction of the label, which comes out of the label conveyor 6, is indicated with X and the conveying direction of the label 3 by means of the driving elements 16 with Y. Through the propelling of the label in the conveying direction Y, the label is delivered from the conveyer platform 7 to the label well 8.

The carriage 18 with the support 20 and thus with the pneumatic piston-cylinder arrangement 17 is adjustable by hand in the conveying direction Y. so that thereby an adapting of the position of the driving elements 16 to the width of the label is possible and, since the position of this lateral edge of the label is predetermined by the abutment wall 9, at this point only a relatively small stroke of the pneumatic piston-cylinder arrangement 17 is necessary to deliver the label 3 to the label well 8. By the fact that the carriage 18 and the support 20 are together adjustable by hand to the width of the label, the pneumatic piston-cylinder arrangement 17 thus always requires only the same amount of travel, i.e. a relatively small pneumatic piston-cylinder arrangement 17 can be used and an adjustment of the stroke of this pneumatic piston-cylinder arrangement 17 is not necessary, but rather the position of the driving elements can be adjusted to the particular label 3 by ordinary operating personnel, without requiring the adjustment of the stroke of the pneumatic piston-cylinder arrangement 17.

From the preceding description it is evident that, regardless of how large the label is, how thick the label is, how long the label is, and where over the length of the label the multiple instructions are applied to the back side of the top side of the label, a completely automatic removing of the label from the stack of labels is possible, that a conveying of the label in front of the label well is ensured, and that through simple hand adjustments the labeling machine according to the invention can be adapted to the most various label sizes by simple, unskilled operating personnel.

What is claimed is:

1. Labeling machine for wet adhesive labels wit a gluing and application device (2) tat holds and directs the labels (3) and is coupled to a label magazine (1) from which tile labels (3) are supplied to the gluing and application device (2), characterized by the fact that in the use of multiple labels a) the label magazine (1) is designed as a support platform (4) with a set-up wall (5) extending over the entire support platform, b) transport means for the labels (3) are provided above the support platform (4) in the region of the set-up wall (5), which means transfer an isolated label (3) to a label conveyer (6) arranged above the set-up wall (5), and c) connected to the label conveyer (6) is a conveyer platform (7), on which the isolated label (3) is conveyed in conveying direction (X) of the label conveyer (6) up to a specified location, and is then conveyed in a direction (Y) perpendicular to conveying direction (X) by carriers (16) abutting a lateral edge (15) of the isolated label (3) to the feed point of the gluing and application device (2).

2. Labeling machine according to claim 1, characterized by the fact that an abutment wall (9) is positioned on the support platform perpendicular to the set-up wall (5).

3. Labeling machine according to claim 1, characterized by the fact that at least one counter support (10) is positioned on the support platform (4) adjustable in a direction of the abutment wall (9).

4. Labeling machine according to claim 1, characterized by the fact that a vacuum suction apparatus (11) is the transport means for the isolated label (3).

5. Labeling machine according to claim 4, characterized by the fact that the vacuum suction apparatus (11) executes a lift-and-swing movement in order to transfer the isolated label (3) to the label conveyer (6).

6. Labeling machine according to claim 1, characterized by the fact that the label conveyer (6) is formed by a draw-in roller (12), which cooperates with counter rollers (14).

7. Labeling machine according to claim 6, characterized by the fact that arranged on the draw-in roller (12) are rubber rings (19) aiding the conveyance of the isolated label (3).

8. Labeling machine according to claim 1, characterized by the fact that the driving elements are arranged on a carriage (18) that is movable back and forth by means of a pneumatic piston-cylinder arrangement (17).

9. Labeling machine according to claim 8, characterized by the fact that the pneumatic cylinder-piston arrangement (17) and tie carriage (18) are arranged on a support (20), wherein the support (20) is adjustable by hand.

* * * * *